United States Patent [19]

Herubel

[11] 4,054,250

[45] Oct. 18, 1977

[54] TEXTILE WINDING MACHINE

[75] Inventor: Jean Frederic Herubel, Guebwiller, France

[73] Assignee: N. Schlumberger & Cie, Guebwiller, France

[21] Appl. No.: 668,903

[22] Filed: Mar. 22, 1976

[30] Foreign Application Priority Data

Nov. 4, 1975 France ..... 75.11365

[51] Int. Cl.[2] ..... B65H 54/42

[52] U.S. Cl. ..... 242/18 DD

[58] Field of Search ..... 242/18 DD, 18 A, 35.5 R, 242/35.5 A

[56] References Cited

U.S. PATENT DOCUMENTS

| | | | |
|---|---|---|---|
| 3,429,514 | 2/1969 | Pospisil et al. | 242/18 A |
| 3,507,453 | 4/1970 | Scragg et al. | 242/18 A |
| 3,552,666 | 1/1971 | Stenmans et al. | 242/18 DD X |
| 3,572,597 | 3/1971 | Parker et al. | 242/18 A |
| 3,682,403 | 8/1972 | Willis | 242/18 A |
| 3,741,490 | 6/1973 | Venot | 242/18 A |
| 3,801,030 | 4/1974 | Kobatake et al. | 242/18 A X |
| 3,899,140 | 8/1975 | Gleyze | 242/18 A X |
| 3,905,560 | 9/1975 | Trifunovic | 242/18 DD |

*Primary Examiner*—Stanley N. Gilreath

*Attorney, Agent, or Firm*—Toren, McGeady and Stanger

[57] ABSTRACT

In a textile winding machine each of a pair of arms is connected at one end to a first wheel and supports a bobbin at the other end in a winding position with the bobbin resting against a driving roller. An endless band, such as a chain, extends around and engages both the first wheel and a second wheel and also passes around a tension roller. The second wheel is connected to a motor for being selectively driven in each of two directions and for driving the first wheel via the endless band. When not driving the second wheel, the motor blocks rotation of the wheels. The tension roller is positioned by the action of tension control means which has an active and an inactive position. The tension control means includes a shoe abutting against a bladder adapted to be connected selectively to a source of compressed air and to a discharge. In the inactive position, when rotation of the second wheel is blocked, winding of the bobbin can proceed and the bobbin can be lifted manually from the driving roller, however, when the tension control means is in the active position the tension roller is displaced against the endless band so that driving of the second wheel in one direction serves to drive the first wheel and raise the bobbin from the driving roller for ejection and replacement with a fresh empty bobbin, and driving in the other direction brings the fresh bobbin into the winding position resting against the driving roller.

2 Claims, 7 Drawing Figures

TEXTILE WINDING MACHINE

This invention concerns textile winding machines of the kind comprising a bobbin which rests on a driving roller to be driven thereby and having an automatic lift mechanism for a bobbin carrier of the machine, which may be, for example, a finisher, an intersecting or a roving frame.

Automatic lift mechanisms of machines of the type in question proceed generally in three phases, namely: (1) ejection of a full bobbin; (2) the fitting of a fresh bobbin; and (3) the application, to the fresh bobbin, of the end of the thread or roving obtained by breakage upon the ejection of the full bobbin.

The control systems for the bobbin carriers of such mechanism pertain, of course, to the first and second of these phases.

In the conventional control systems, the bobbin being wound, as well as a full bobbin, are kept in place by arms controlled by a mechanism comprising toothed sectors and wheels. However, the parts of the mechanism are relatively heavy, bulk, onerous, and this is particularly important since the number of mechanisms is a function of the number of winding stations which the machine comprises. In addition, the replenishing with slubbing bobbins is also effected by complex, heavy and troublesome mechanisms, in a number equal to that of the winding stations and, accordingly, numerous; the result is that the whole of the automatic bobbin changing installation is not very practical, is costly, is not very remunerative and is not very reliable.

An object of the invention is to provide a control system for a bobbin carrier which does not have the above discussed disadvantages.

With this object in view, the present invention provides a textile winding machine comprising a rotary driving roller against which a slubbing bobbin is held by a bobbin carrier, characterised in that the slubbing bobbin is supported by its two ends by means of two arms mounted to rotate with a first idle wheel loosely mounted to rotate about a horizontal axis and over which there passes a substantially inextensible flexible band which also passes around a second wheel coupled to a motor adapted to be driven selectively in the one direction and the other direction, and when not driven to block rotation, one of the runs of the band also extending around a tension roller capable of assuming selectively an active position and an inactive position under the action of suitable tension control means in such a way that when the tension roller is in the inactive position and rotation of the second wheel is blocked by the motor, winding, and manual intervention at the bobbin in course of winding, are possible by formation of slack in the inextensible flexible band, whereas when the tension roller is in the active position, rotation of the second wheel in the one direction permits ejection of a full bobbin and replacement thereof with a fresh empty slubbing bobbin, and in the other direction provides for moving the fresh empty slubbing bobbin into the winding position held against the rotary driving roller.

The arrangement of the invention provides a whole series of advantages, notably:

since the inextensible flexible endless band allows the bobbin carrier arms to take up the fresh bobbin, without some other mechanism having to present the fresh bobbin to them, such a mechanism for replenishing with fresh slubbing bobbins is no longer necessary, which simplifies, reduces the weight of, and above all renders the machines less expensive and more reliable, than the known machines. In other words, the arrangement of the invention allows for ejection of the full bobbin and replacement with a fresh slubbing bobbin to be effected by the movements of a single member;

by obviating the need for heavy parts for controlling the bobbin-carrier arms, the whole of the automatic bobbin changing mechanism becomes lighter, simpler, more flexible in use, less bulky and less onerous, than in the known machines;

by involving simpler and more rational movements, the assembly becomes more flexible in use, more rapid, more lucrative and more reliable. In addition, since the parts are less numerous and lighter, they offer less inertia to their entrainment, which reduces the consumption of energy and allows more rapid operation;

thanks to the possibility of forming a slack portion in the inextensible flexible band, one has the possibility of keeping the bobbin of any one of the winding stations in a position of intervention without disturbing the functioning of the other stations and one can also place, or replace, in any station, a bobbin whose size is different from that of the bobbins in course of formation in the other stations, without it being necessary to effect any supplementary manoeuvre or any other adjustment.

The invention will be described further, by way of example, with reference to the accompanying drawings which illustrate, by way of a non-restrictive example, one embodiment of a winding machine in accordance with the invention. In these drawings, which are all diagrammatic:

Figure 5:
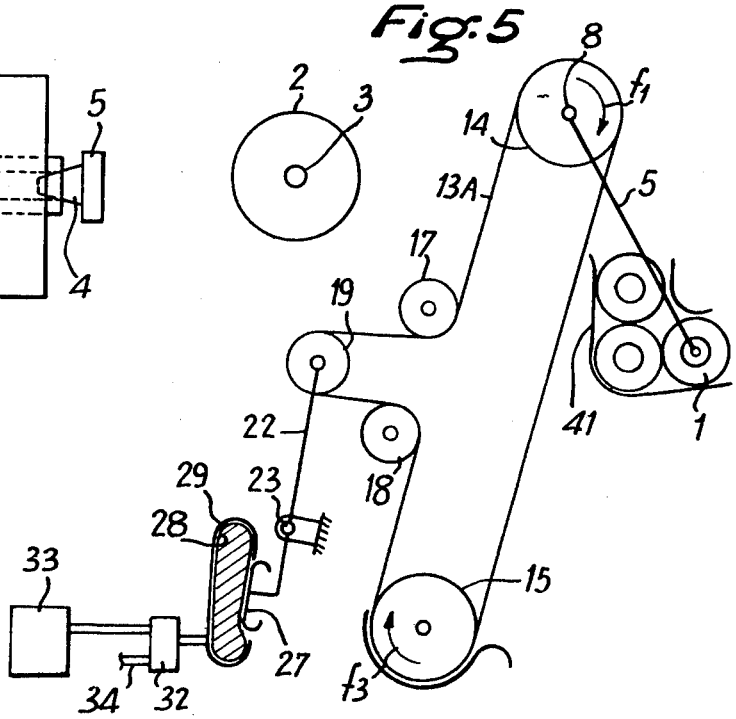
FIG. 5 is a view similar to FIGS. 1, 2 and 3 but illustrating the parts in the take-up position of an empty slubbing bobbin.
Figure 6:
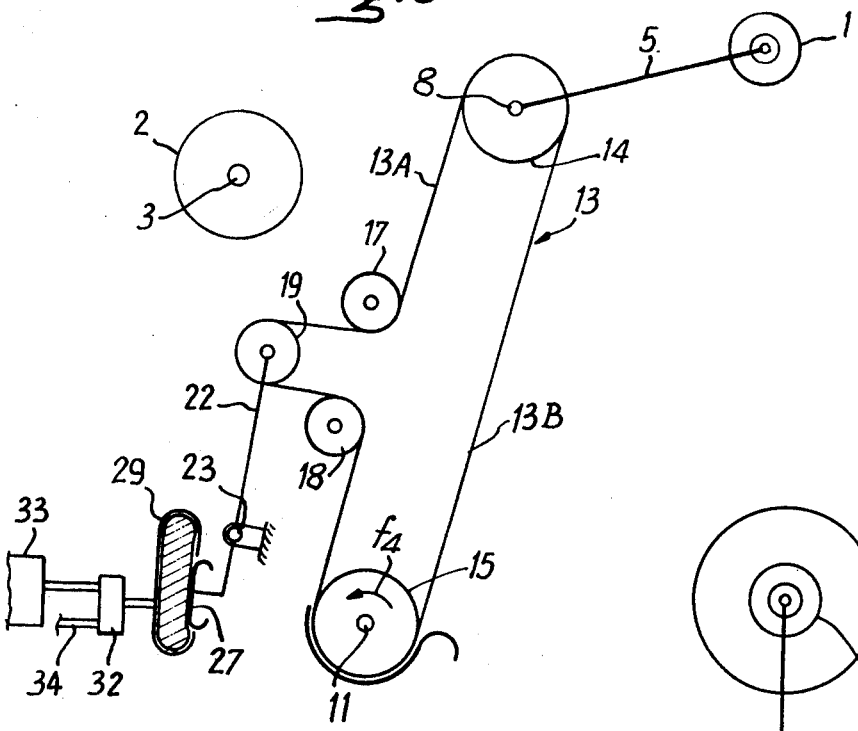
Figure 7:
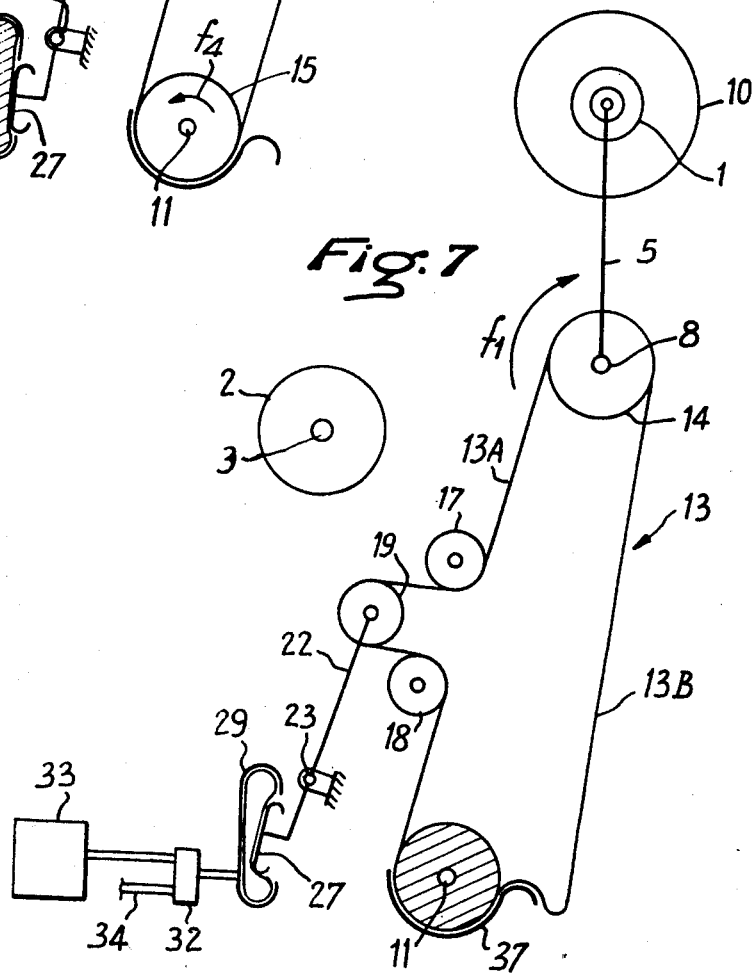

FIG. 6 is a view similar to FIGS. 1 to 3 and 5 but illustrating the return of the bobbin carrier to the winding position; and FIG. 7 is a view comparable with FIGS. 1 to 3 and 5 and 6 but showing the relative positions of the parts resulting from manual intervention at the slubbing bobbin in course of winding thereof.

Figure 1:
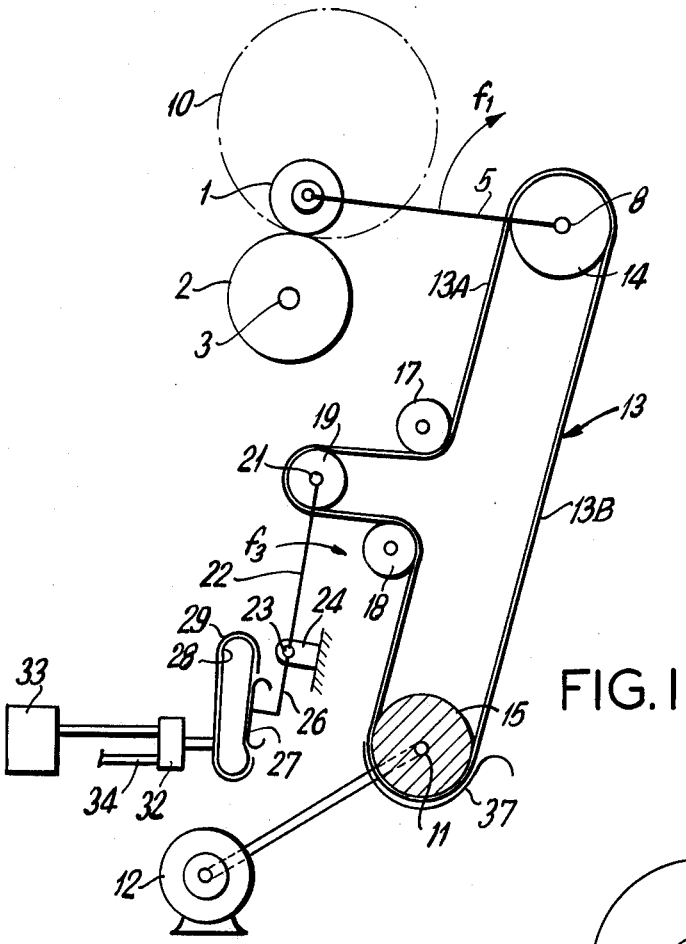
FIG. 1 is a side elevation illustrating the whole of the mechanism of one winding station of the machine, the mechanism being shown in a starting position of a winding cycle.
Figure 4:
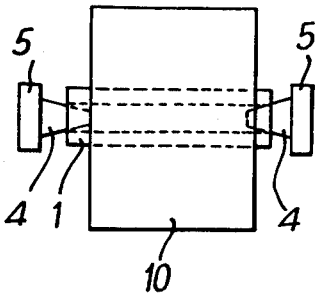
FIG. 4 is a detached front view of the upper part of FIG. 3 observed in the direction of the arrow IV.

The winding-up arrangement for a slubbing bobbin 1, shown schematically in elevation in FIG. 1, comprises a horizontal driving roller 2 carried by a shaft 3 and upon which rests a slubing bobbin 1 mounted loosely for rotation on two pivots 4 (see also FIG. 4). Each pivot 4 is carried by a respective one of the ends of two arms 5 whose other ends are fast with a horizontal shaft 8. The free ends of the arms 5 can be separated slightly relative to one another to free a wound-up slubbing bobbin, and on the other hand can be closed up towards one another in order to retain between them an empty slubbing bobbin or one in course of winding. This separating or closing together of the arms is effected by conventional means, for example having pneumatic control, which need not be described in detail here.

Pivoting movements of the shaft 8 are effected from a main driving shaft 11 entrained by a motor 12 capable of being driven selectively in one direction and the other and which, when not being driven, has its output shaft braked so that it will not rotate. The shaft 8 is connected to the main driving shaft 11 by a transmission which comprises an inextensible flexible endless band 13, constituted for example by a chain, which passes over a first-toothed wheel 14 fast on the shaft 8 and over a second toothed wheel 15 fast on the shaft 11. Run 13A of the chain 13 also passes over two detour rollers 17, 18 of fixed locations, and over a tension roller 19 mounted, for free rotation, on a shaft 21 carried by the free end of an arm 22 which can pivot about an axis 23 carried by a fixed support 24. The arm 22 has, beyond its pivot 23, an extension 26 which carries a shoe 27 which seats against an inflatable bladder 28 accomodated in a casing 29 and adapted to be connected selectively, by a distributor 32, either to a source 33 of fluid under pressure, for example compressed air, or to a discharge conduit 34.

Since, during operation of the device, the chain 13 is required to slacken, the lower portion of the toothed wheel 15 is surrounded by a guide 37 which prevents the chain 13 from disengaging from the teeth of said wheel 15 when it slackens.

Figure 2:
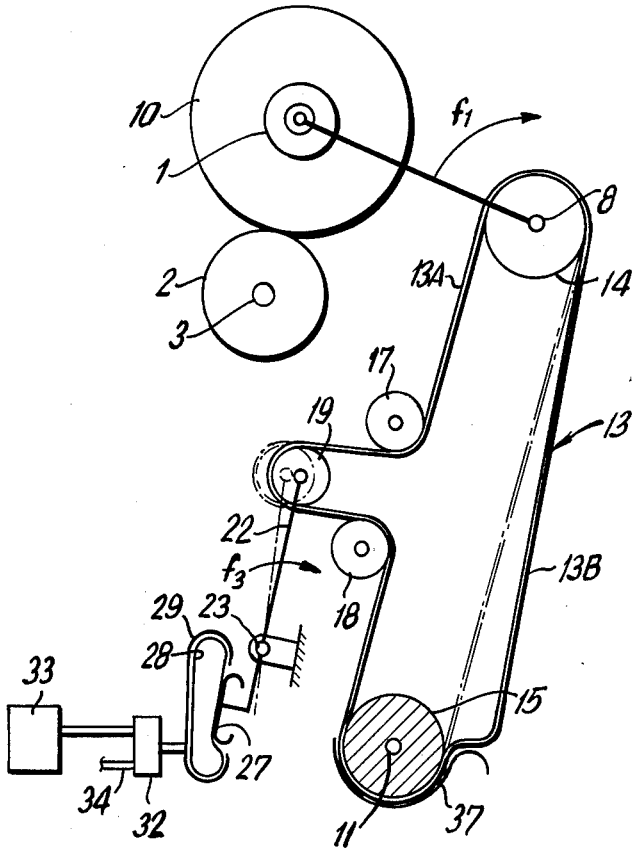
FIG. 2 is a view similar to FIG. 1, but showing the relative positions of the various parts at the end of the winding operation.
Figure 3:
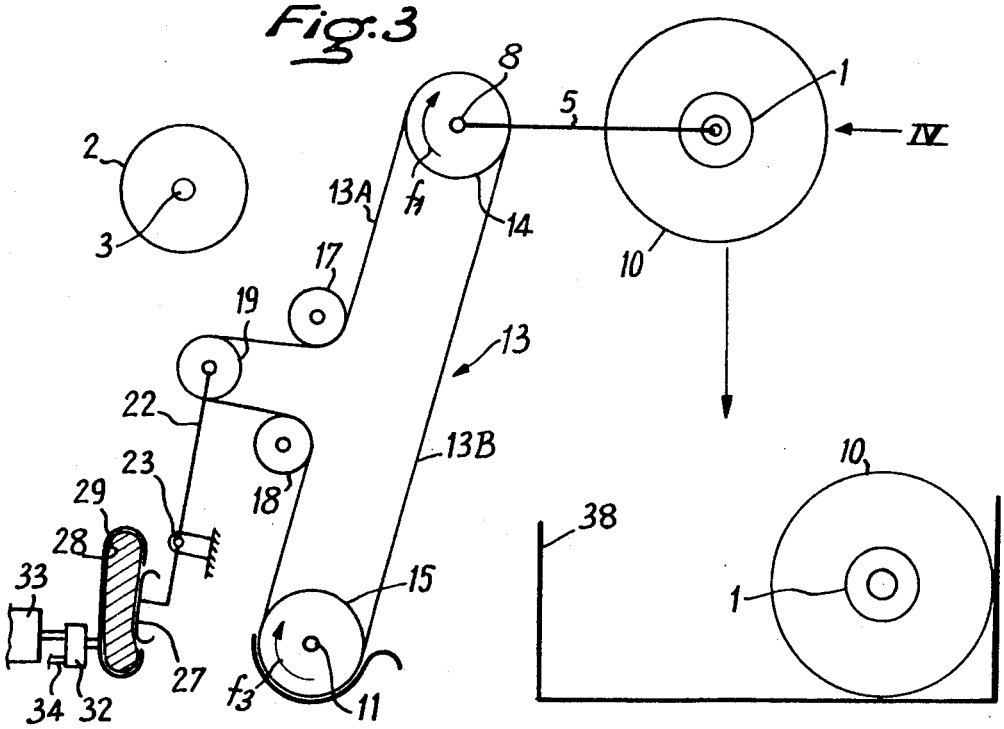
FIG. 3 is a similar view, but illustrating the parts during the ejection of a full bobbin.

The operation of the arrangement is as follows:

At the start of a bobbin-winding cycle, an empty slubbing bobbin 1 (FIG. 1) is aplied to the driving roller 2 so as to rest thereon under the effect of its own weight and the weight of the arms 5, increased if necessary with the aid of a suitable elastic means for example a spring or a weight (not shown). The motor 12 is stopped so that the main driving shaft 11, and the toothed wheel 15 which it carries, are stationary and prevented from rotation, the stationary condition of the wheel 15 being symbolised by hatching thereon in FIG. 1. The bladder 28 is put to the discharge conduit 34 by the distributor 32. As winding of thread or roving onto the slubbing bobbin 1 proceeds, until the wound bobbin reaches a desired size such as has been shown in dot-dash lines at 10 in FIG. 1, the two arms 5 pivot correspondingly upwards about the geometrical axis of the shaft 8 in the direction of the arrow *f*1. The toothed wheel 14 therefore turns correspondingly in the same direction, as the lower toothed wheel 15 is blocked against rotation by the motor 12, the run 13A of the chain 13 tightens and forces the tension roller 19 to draw closer to the two detour rollers 17, 18. This causes the arm 22 to pivot in the direction of the arrow *f*3, as shown in FIG. 2, so that the shoe 27 presses against and tends to flatten the bladder 28 which offers very little resistance as it is open to the discharge conduit 34. At the same time, the other run 13B of the chain 13 slackens to assume a configuration such as is shown in full lines in FIG. 2, the lower portion of this chain run resting on the guide 37.

The bobbin 10 having now reached the desired diameter, it is appropriate that exchange thereof should be effected. For this, one commences by actuating the distributor 32, to open it to the pressure fluid souce thereby to put the bladder 28 under pressure, as has been symbolised by hatching in FIG. 3 and also switching on the motor 12 so as to turn in the direction which causes rotation of the main driving shaft 11 in the direction of the arrow *f*3 in FIG. 3. This has the effect, at first, of taking up the slack in the run 13B of the chain 13 and returning the tension roller 19 to its position most remote from the two detour rollers 17, 18, after which the chain 13, now tautened over its entire length, commences to entrain the upper shaft 8 and, with it, the toothed wheel 14 and the arms 5, in the direction of the arrow *f*1, as far as the substantially horizontal position shown in FIG. 3, at the side opposed to the winding position of FIG. 1, relative to the shaft 8. At this moment, the free ends of the arms 5 are caused to separate from one another and allow the full bobbin 10 to fall into a reception tub 38 in which there may already be other full bobbins 10. Separation of the free ends of the arms 5 may be effected by means of any suitable, e.g. pneumatic, arrangement.

The pivoting movement of the arms 5 continues in the direction of the arrow *f*1, under the action of the motor 12 which continues to run in the same direction, until the arms 5 reach the lower position, shown in FIG. 5, where their free ends are closed up towards one another in order to engage and take up a fresh empty slubbing bobbin 1 located in a supply guide 41, of conventional type, provided for the purpose. During the very short period of time during which the fresh empty bobbin is taken up, the motor 12 is stopped so that the arms 5 are stationary. Substantially straight away, the motor 12 is started up again in the opposite direction to cause the main shaft 11 to turn in the opposite direction, that is to say the direction of the arrow *f*4 (FIG. 6) in order to raise the arms 5 loaded with the fresh slubbing bobbin and cause them to resume the initial position of FIG. 1 for the start of a new winding cycle. For this, the bladder 28 is connected to the discharge line 34 once more. Thus, the bladder 28 is under pressure only during the bobbin replacement operation, that is to say during lifting of the full slubbing bobbin, the loading of an empty slubbing bobbin and the movement of the latter back to the winding position.

During the greater part of the time, more especially during the whole of the duration of the winding operation, the bladder 28 is connected to the discharge line 34 and the motor 12 is stopped, so that it is possible, at any time during the winding operation, to intervene manually at the bobbin, by pivoting the arms 5 in the direction of the arrow *f*1 as far as the position shown in FIG. 7, since during that period the tension roller 19 is not subjected to the influence of the bladder 28 and, accordingly, one can shorten the run 13A of the chain 13 without the pivoting movement of the arms 5 and rotation of the toothed wheel 14 being hindered, the other run 13B of the chain simply slackening.

It will be appreciated that, on a textile machine comprising a large number of winding stations such as the one which has just been described, all actuated from a common lower main driving shaft 11 and provided with a common bladder 28, with each station comprising its own control system comprising a chain 13, its toothed wheel 14, its arms 5, its detour rollers 17, 18, its tension roller 19 and its shoe 27, manual intervention at any one of the bobbins in course of being wound does not cause any disturbance at any of the winding stations of the machine. This intervention can take place at any time during the winding operation and the bobbin being formed can be brought back into engagement with the driving roller at any moment.

Of course, the invention is not restricted to the embodiment described and shown, and modifications can be made thereto, according to the applications envisaged, without departing from the scope of the following claims.

Thus, for example, instead of a chain, one could use a belt, preferably a notched belt, and the control of the tension roller can be effected by means other than a pneumatic bladder.

I claim:

1. A textile winding machine comprising a rotary driving roller, a pair of supporting arms for supporting a slubbing bobbin in a winding position resing on said rotary driving roller to be driven thereby, engagement means carried on one end of each of said arms so that said engagement means each engage an opposite end of the bobbin, a first wheel mounted for rotation about a horizontal axis, the other ends of said arms being secured to said first wheel, an endless band extending around and engaging said first wheel, a second wheel spaced from said first wheel and around which said band extends in engagement with said second wheel, a motor drivingly connected to said second wheel, said motor being arranged to drive said second wheel selectively in one direction and in the opposite direction and when not being driven to block rotation of said second wheel, a movable tension roller being freely rotatably mounted, one run of said band extending around and over said movable tension roller, and tension control means operatively connected to said movable tension roller and capable of assuming selectively one of an operative position and an inoperative position wherein said tension control means when in the inoperative position permits displacement of said movable tension roller when the rotation of said second wheel is blocked by said motor whereby movement of said arms supporting the bobbin during winding or manual operation are made possible by the provision of slack in said endless band, and wherein said tension control means when in the operative position displaces said tension roller against said endless band for taking up the slack in said endless band when rotation of said second wheel by said motor in said one direction serves to drive said endless band which in turn drives said first wheel for raising said arms supporting the bobbin for displacing the bobbin from said arms and for replacement by a fresh bobbin, and rotation of said second wheel by said motor in said opposite direction serves to return said arms supporting the fresh bobbin into the winding position resting against said driving roller.

2. A textile winding machine as set forth in claim 1, characterized in that said tension control means comprises a pneumatic bladder, a shoe connected to said tension roller and abutting said bladder, and a distributor connected to said bladder for selectively connecting said bladder to one of a source of compressed fluid and to a discharge.

* * * * *

UNITED STATES PATENT OFFICE

CERTIFICATE OF CORRECTION

Patent No. 4,054,250 Dated October 18, 1977

Inventor(s) Jean Frederic Herubel

It is certified that error appears in the above-identified patent and that said Letters Patent are hereby corrected as shown below:

In the heading of the Letters Patent[30] it should read as follows:

-- [30] Foreign Application Priority Data

April 11, 1975 France.....75 11365--.

Signed and Sealed this

Third Day of April 1979

[SEAL]

Attest:

RUTH C. MASON
Attesting Officer

DONALD W. BANNER
Commissioner of Patents and Trademarks